US005815863A

United States Patent [19]

Dolisi

[11] Patent Number: 5,815,863

[45] Date of Patent: Oct. 6, 1998

[54] LATERAL SLUMBER SUPPORT WITH PIVOTABLE KNEE SUPPORTING PILLOW

[76] Inventor: Frank Dolisi, 21 Woodland Rd., Old Brookville, N.Y. 11545

[21] Appl. No.: 935,434

[22] Filed: Sep. 23, 1997

[51] Int. Cl.[6] ..... A47C 20/00; A47C 21/00; A47G 9/00

[52] U.S. Cl. ..... 5/632; 5/482; 5/648; 5/930

[58] Field of Search ..... 5/632, 630, 482, 5/930, 648, 631, 650

[56] References Cited

U.S. PATENT DOCUMENTS

| | | | |
|---|---|---|---|
| 3,148,387 | 9/1964 | Sarnie, Jr. et al. | 5/648 |
| 4,197,603 | 4/1980 | Greenhawk, Sr. | 5/630 |
| 4,901,384 | 2/1990 | Eary | 5/632 |
| 5,097,551 | 3/1992 | Smith | 5/632 |
| 5,269,323 | 12/1993 | Krouskop | 5/632 |
| 5,357,641 | 10/1994 | Schubert | 5/632 |

*Primary Examiner*—Alexander Grosz
*Attorney, Agent, or Firm*—Alfred M. Walker

[57] ABSTRACT

A lateral slumber support member includes a longitudinally extending wedge shaped pillow, for supporting a user, such as a pregnant woman, in a lateral slumber support, while lying down on either the left side or the right side, with the longitudinally extending wedge shaped pillow providing compressible, but firm support for the spine and pelvic region of the user. The longitudinally extending wedge shaped pillow has a triangular cross section, and has an interior body made of a firm, compressible elastic material, such as foam, which can provide support, but which easily conforms to the spinal and pelvic regions of the user. The wedge-shaped pillow includes a fabric cover which is permanently sewn to a bed sheet along an imaginary line dividing the sheet in half so it can be used by the user lying on either the left or right side. Because the wedge-shaped pillow is sewn to the sheet, it is held in place by virtue of the fact that the corners portions of the sheet are tucked under the corners of the mattress, while being attached to the sheet. The lateral slumber support member further includes an optional reverse position knee clasping pillow, which is attached by a flange to an edge of the wedge support pillow, so that the user can insert the knee clasping pillow between the knees of the user for further comfort. This knee clasping pillow moves pivotably from either a right side lying position or left side lying position.

9 Claims, 5 Drawing Sheets

LATERAL SLUMBER SUPPORT WITH PIVOTABLE KNEE SUPPORTING PILLOW

FIELD OF THE INVENTION

The present invention is related to supports for pregnant women.

BACKGROUND OF THE INVENTION

During pregnancy it is beneficial to have a pregnant women lie laterally on one side. In order to make this position more comfortable, it is beneficial to provide a support behind the women's back, so that the body can be held laterally on one side.

There have been attempts to support pregnant women in various positions.

Among prior art includes U.S. Pat. No. 4,397,052 of Lund describes a wedge shaped pillow wherein the woman rests between a concave section for the abdomen on one side and a back rest on the other side. Also, U.S. Pat. No. 4,288,879 of Pate describes a wedge shape foam rubber pillow to support a pregnant woman on her side.

The remaining patents, namely U.S. Pat. Nos. 4,021,872 of Powell, 4,193,150 of Vineberg, 4,737,999 and 4,819,287 both of Halverson, 4,508,284 of Castelot, 4,827,541 of Vollman, 4,944,059 of Wall, 5,029,349 of Hamilton, 5,054,142 of Owens, 5,086,529 and U.S. Pat. No. Des. 348,792 both of DeGroot, 5,103,516 of Stevens, 5,185,897 of Van Laanen, 5,231,717 of Scott, 5,237,712 of Ramsay, 5,369,824 of Powell, 5,400,449 of Satto, 5,412,824 of Emerson, 5,339,471 of Lanzara, 5,438,715 of Jackman and U.S. Pat. No. Des. 357,538 of Sockwell describe various maternity support members, such as, for example, a maternity mattress or pillow, to support a pregnant woman in a prone face-down position.

Furthermore, U.S. Pat. No. Des. 350,586 of Francis discloses a flotation cushion with a head pillow attached to the body support member, such as a mattress.

However, the problem with the prior art is that many of the patents, such as Satto '449, support the woman in a prone position. The only known device which supports a person in a lateral position is in Lund '052, which provides a wedge-shaped back support, however, but which holds the woman in place by a front short abdominal wall. This pillow of Lund '052 is often uncomfortable as it does not have natural sheet and mattress below the woman and it cramps the woman in an uncomfortable immovable position.

Furthermore, the Pate '879 provides a wedge shape. However, it is an abdominally facing pillow, wherein the wedged shape pillow has a concave section for insertion of the abdomen. Such a device provides no lateral rear back support for the woman.

Another drawback to Pate '879 is that it is self-supporting on a bed and nothing holds the wedge shaped pillow in place.

Also, U.S. Pat. No. 4,193,150 of Vineberg also describes a wedge-shaped mattress which is placed over a horizontal mattress. However, this wedge-shaped mattress is to maintain a person in a slightly upright position and just give support under the head, neck and thorax of a reclining position with the legs supported by the horizontal mattress.

The wedge-shaped mattress is held in place under a sheet, however, it is not held within a specified compartment defining the wedge-shape, so that it is prone to move in place under the sheet.

Furthermore, U.S. Pat. Nos. 5,647,076 of Gearhart and 5,652,981 of Singer-Leyton both describe U-shaped pillows for supporting a pregnant woman in the prone face-down position.

In addition, U.S. Pat. No. Design 350,586 of Francis shows a pillow portion permanently attached to a floatation cushion for use by pregnant woman.

However, these prior art patents do not describe the lateral slumber support which can be removable from a enclosure, wherein the enclosure holds the wedge-shaped support in position by virtue of being attached to a sheet, which is held in place by being tucked into the edges of the mattress.

OBJECTS OF THE INVENTION

It is therefore an object of the invention to provide a lateral slumber support for a pregnant woman.

It is also an object of the present invention to provide lateral slumber support for a pregnant woman which maintains the woman comfortably on the side with a support from the rear.

It is further object of the present invention to provide a lateral slumber support for a pregnant woman which is firmly held in place.

It is another object of the present invention to provide a bedding set, wherein the lateral slumber support is sewn into a sheet so that the slumber support may provide comfort so the pregnant woman.

It is also an object of the present invention to provide a lateral slumber support pillow with an auxiliary reverse position knee clasping pillow which can accommodate a woman lying on either the right side or left side.

SUMMARY OF THE INVENTION

In keeping with these objects and others which may become apparent, the present invention is a longitudinally extending pillow having a compressible body therein for supporting a user, such as a pregnant woman, in a lateral slumber support position, while lying down on either the left side or the right side, with the interior body of the longitudinally extending wedge shaped pillow providing compressible, but firm support for the spine and pelvic region of the user.

The interior pillow body of the wedge shape pillow is made of a firm, compressible elastic material, such as foam, which can provide support, but which easily conforms to the back section of the woman.

The wedge-shaped pillow is held in place since it includes a fabric cover sewn to a sheet along an imaginary line dividing the sheet in half so the wedge-shaped pillow can be used by a user lying on either the left or right side. Because the wedge-shaped pillow is held within the fabric covering permanently sewn to the sheet, it is held in place by virtue of the fact that the sheet is tucked into the corners of the bed by being attached to the sheet. Therefore, whenever the sheet is held in place by being tucked into the corners of the mattress, the pillow will not shift or move in place when the woman's body weight is placed against it. This provides a firm lumbar and back support for the woman without the need for the woman to uncomfortably compensate for a pillow that can slip and move out of place.

In a preferred embodiment, the lateral slumber support of the present invention further includes an optional reverse position knee clasping pillow which is attached by a flange to an edge of the fabric wedge support pillow cover, so that the woman can insert the pillow between the knees for further comfort, or to reduce leg swelling edema. The pillow moves pivotably from either a right side lying position or left side lying position.

Consequently, the lateral slumber support of the present invention firmly holds the woman in place in a preferred lateral slumber support position comfortably and without shifting in position. There is no intermediary abdominal retaining material, such as in Lund '052, to cramp the woman in an uncomfortable position and the wedge-shaped pillow is adjacent to the natural sheet material, which in turn, holds the wedge-shaped pillow in place by virtue of the sheet being tucked under the corners of the bed.

DETAILED DESCRIPTION OF THE DRAWINGS

Figure 1:
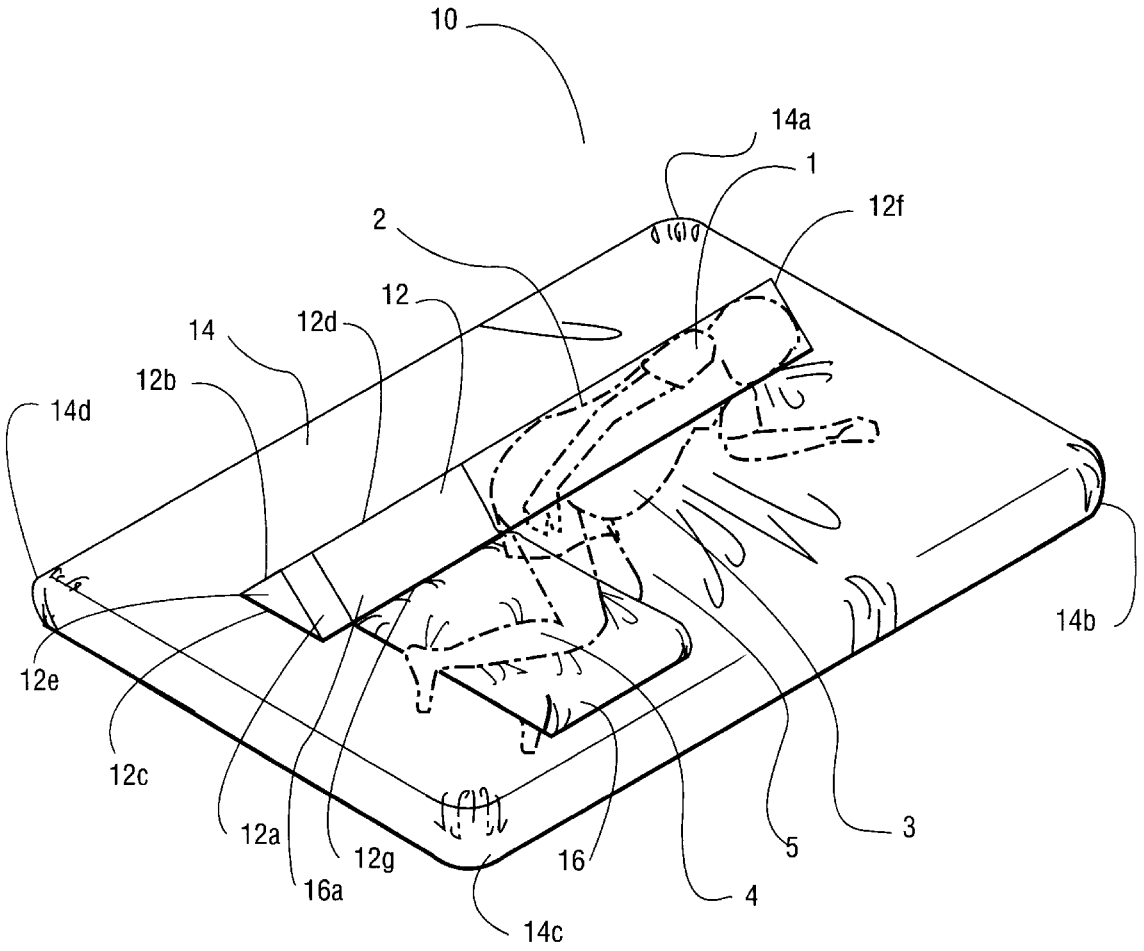
FIG. 1 is a perspective view of the lateral slumber support of the present invention showing a woman in dotted lines in use.
Figure 2:
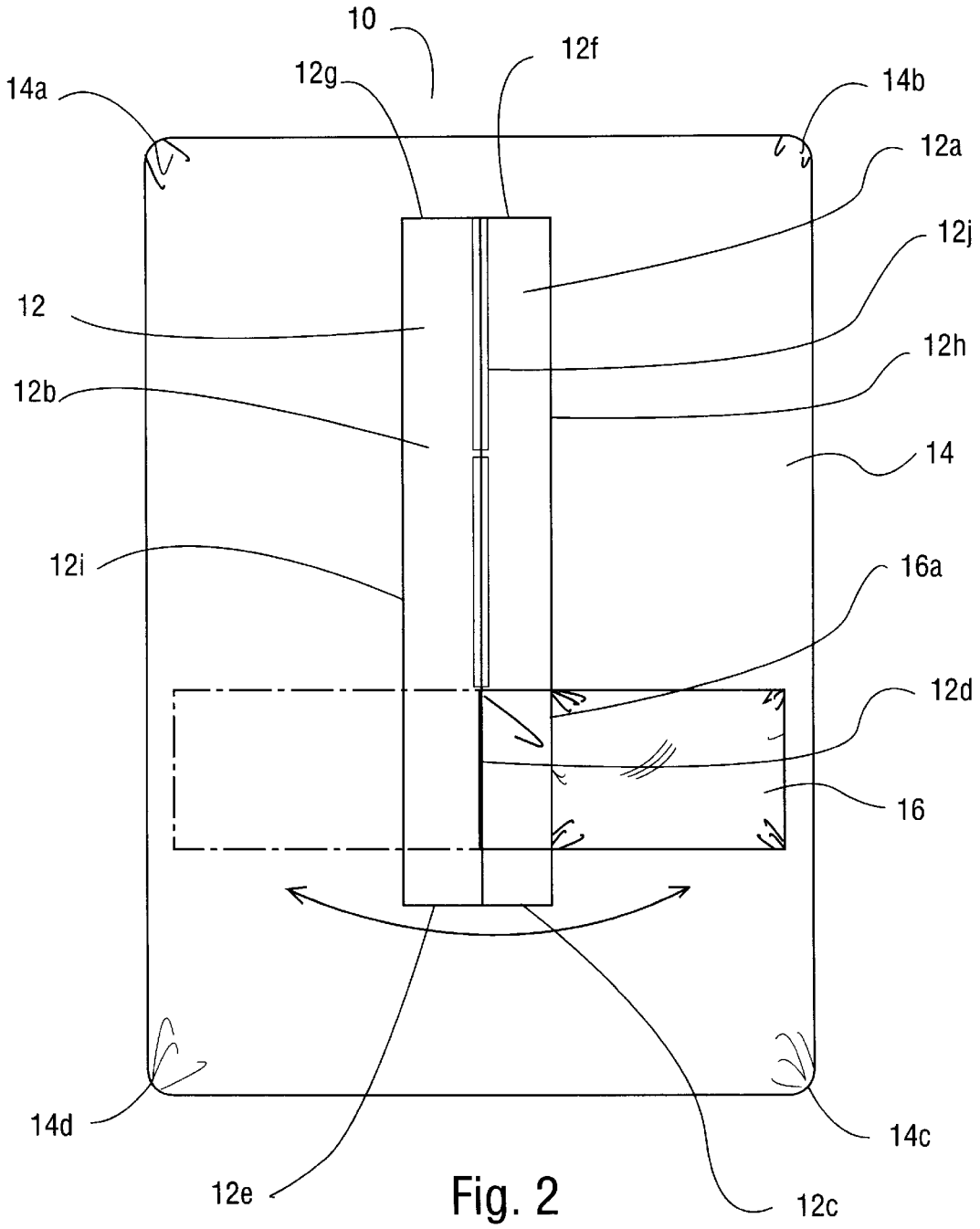
FIG. 2 is top plan view of the lateral slumber support as in FIG. 1.

As shown in FIG. 1, a user 1, having spine and pelvic region 2, abdomen 3 and knees 4,5 such as a pregnant woman, is shown lying in a preferred lateral slumber support position on the right side with the spine and pelvic region resting against lateral slumber support member 10. Lateral slumber support member 10 of the present invention can accommodate user 1 lying on either the right side or the left side.

Lateral slumber support member 10 includes wedge-shaped pillow 12 which is attached to bed sheet 14 which is tucked under the edge of a conventional mattress. Wedge-shaped pillow 12, made of fabric, such as linen, cotton and the like, includes upwardly extending oblique walls 12*a*, 12*b*, which rise up from horizontal base 12*c* to meet at upper common edge 12*d*. Preferably the ends 12*e*, 12*f* of wedge-shaped pillow 12 are triangular in shape, with edges corresponding to the edges of oblique walls 12*a*, 12*b*, and with an apex corresponding to upper edge 12*d* of wedge-shaped pillow 12. Wedge-shaped pillow 12 is attached at lower portion 12*g* along base edges 12*h*, 12*i* to support sheet 14.

Figure 5:
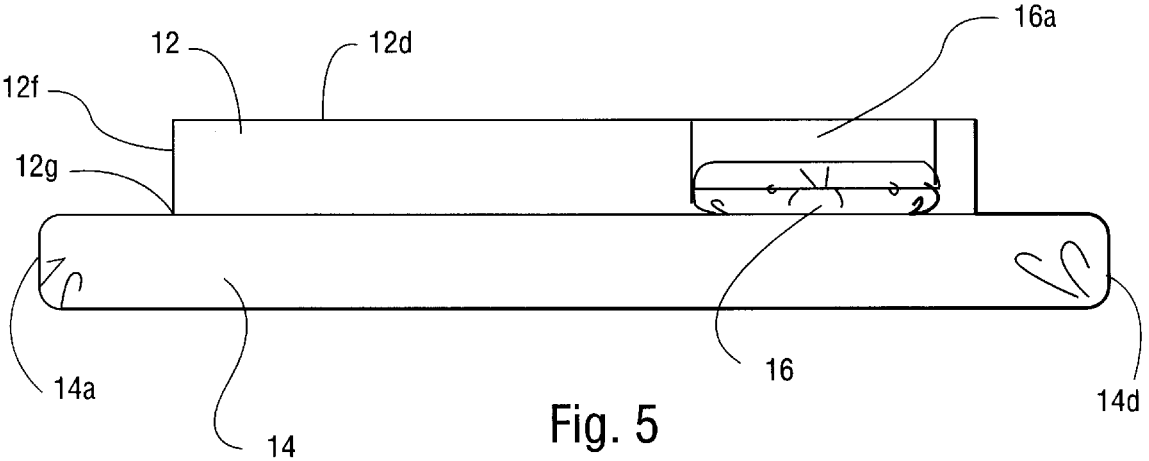
FIG. 5 is a side elevational view of a lateral slumber support as in FIG. 1, showing the pillow portion being reversed in position.
Figure 6:
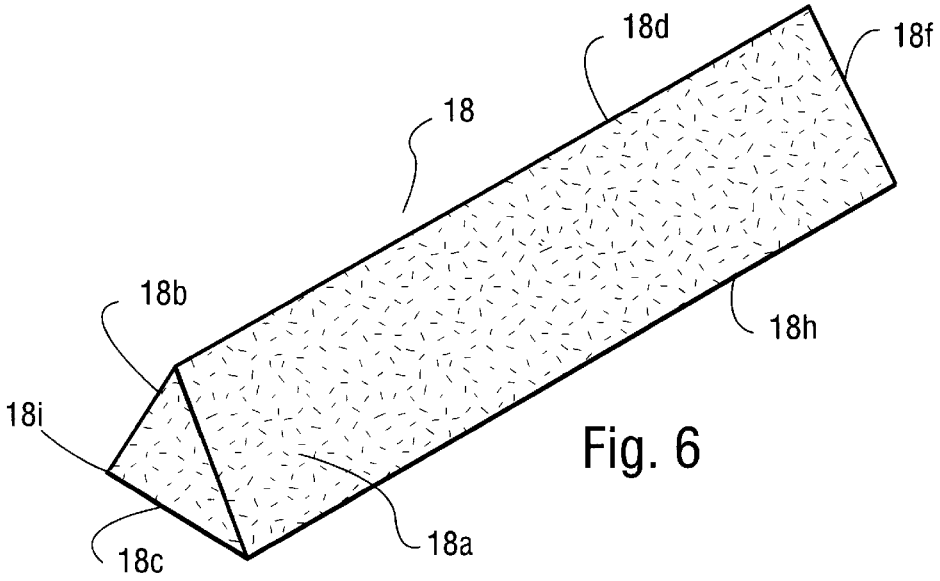
FIG. 6 is a perspective view of the wedge-shaped pillow interior body.

In a preferred embodiment, optional knee 4,5 clasping pillow 16 is provided for insertion between the knees of user 1. Knee clasping pillow 16 is attached by flange member 16*a* to wedge-shaped pillow 12 so that knee clasping pillow 16 can be pivoted and flipped from the right side slumber position, as in FIG. 1, to the left side slumber position, as shown in FIG. 5.

Although longitudinally extending lateral slumber support member 10 can have various geometric configurations, such as a parallelopepid or a cylinder, lateral slumber support member 10 preferably includes wedge-shaped pillow 12, having interior pillow body 18. Both wedge-shaped pillow 12 and wedge-shaped interior pillow body 18 are triangular in cross section. Wedge-shaped interior pillow body 18 has oblique side members 18*a*, 18*b*, which side members 18*a*, 18*b* are joined at bottom edges 18*h*, 18*i* at bottom base 18*c* and top edge 18*d* thereof. Respective front and rear ends 18*e* and 18*f* of wedge-shaped interior pillow body 18 are generally flat.

Figure 7:
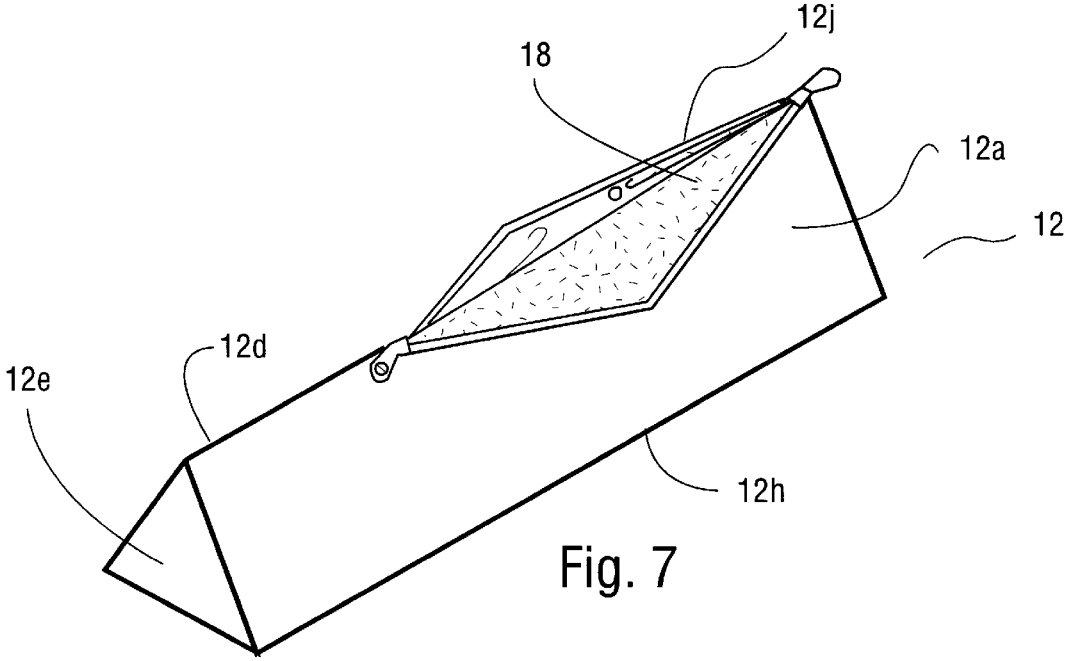
FIG. 7 is a close up view of the wedge-shaped pillow shown in a partially open position, with a foam pillow interior body therein, of the lateral slumber support of the present invention.

Wedge-shaped interior pillow body 18 is inserted within wedge-shaped pillow 12, which wedge-shaped pillow 12 opens by longitudinally extending opener means 12*j*, such as a zipper, extending along top edge 12*d* of wedged shaped pillow 12, as shown in FIG. 7. Therefore, longitudinally extending wedge-shaped pillow 12 is held positionally stable in place, without shifting out of a desired location on sheet 14, because wedge-shaped pillow 12 is permanently attached to sheet 14 at a lower portion 12*g* along edges 12*h*, 12*i* thereof, such as by sewing, so that wedge shaped pillow 12 is permanently sewn in place upon sheet 14, which sheet 14 is tucked in under the edges of the mattress at respective corners 14*a*, 14*b*, 14*c* and 14*d* of sheet 14.

Longitudinally extending wedge-shaped pillow interior body 18 is made of any firm compressible pillow material, preferably a firm compressible elastic foam.

In the preferred embodiment shown in FIGS. 1,2,4 and 5 for lateral slumber support member 10, optional knee clasping pillow 16 is provided, which can be pivotably flipped in place, as noted above. Knee clasping pillow 16 may be used for comfort, or also to reduce leg swelling edema, by alternately raising each leg on top of knee clasping pillow 16.

Figure 3:
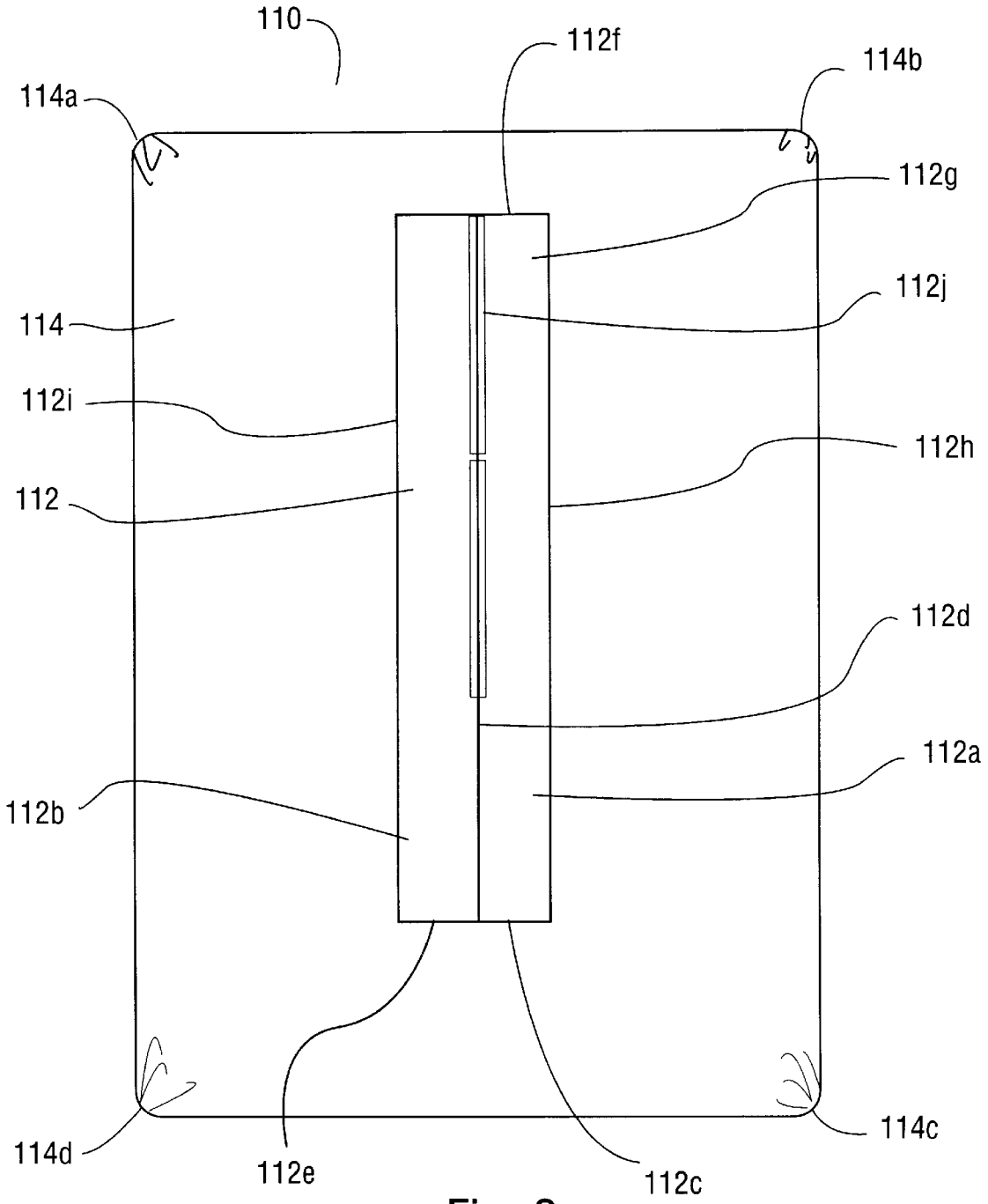
FIG. 3 is a top plan view of an alternate embodiment for a lateral slumber support of the present invention.
Figure 4:
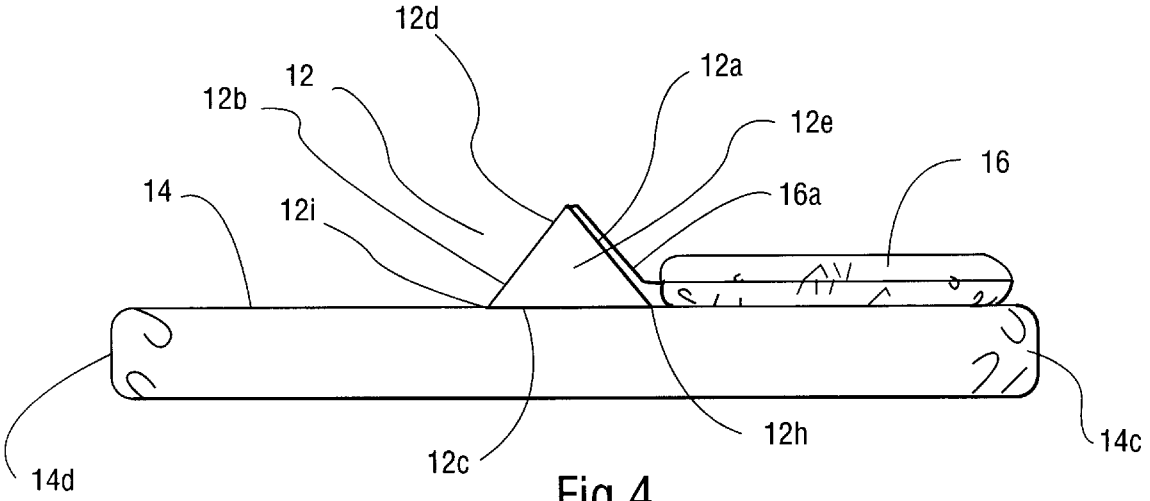
FIG. 4 is front elevational view of a lateral slumber support as in FIG. 1.

However, in an alternate embodiment for lateral slumber support member 110, no knee clasping pillow is provided, as shown in FIG. 3.

In this alternate embodiment, wedge-shaped pillow 112 has oblique walls 112*a*, 112*b* rising from base 112*c* to common apex edge 112*d* and triangular end walls 112*e*, 112*f*. Lower portion 112*g* of wedge-shaped pillow 112 is attached at base edges 112*h*, 112*i* to sheet 114. Wedge-shaped pillow 112 opens by longitudinally extending opener means 112*j*, such as a zipper, extending along top edge 112*d* of wedged shaped pillow 112, as shown in FIG. 3. Therefore, longitudinally extending wedge-shaped pillow 112 is also held positionally stable in place, without shifting out of a desired location on sheet 114, because wedge-shaped pillow 112 is permanently attached to sheet 114 at a lower portion 112*g* along edges 112*h*, 112*i* thereof, such as by sewing, so that wedge shaped pillow 112 is permanently sewn in place upon sheet 114, which sheet 114 is also tucked in under the edges of the mattress at respective corners 114*a*, 114*b*, 114*c* and 114*d* of sheet 114.

It is further noted that other modifications may be made to the present invention, without departing from the spirit of the invention, as noted in the appended claims.

I claim:

1. A lateral slumber support member, which lateral support member can accommodate the back of a user lying on either his or her right side or left side, said lateral slumber support member comprising:

a longitudinally extending pillow adapted to support the back of a user lying on his or her side, said pillow having at least a right and a left side, said pillow being attached to a support sheet generally along a longitudinal line extending generally centrally along said support sheet said support sheet adapted to cover a conventional mattress, said support sheet, adapted to be maintained in an immovable position by being tucked under the edges of a conventional mattress; and, a pivotable reverse position knee clasping pillow being provided for insertion between the knees of the user, said pivotable reverse position knee clasping pillow being attached by a flange member to said longitudinally extending pillow at a lower end area thereof, whereby said pivotable reverse position knee clasping pillow is pivotable relative to said longitudinally extending pillow from a first position lying on the support sheet, adjacent the right side of the longitudinally extending pillow, to a second position lying on the support sheet, adjacent the left side of the longitudinally extending pillow.

2. The lateral slumber support member as in claim 1, wherein said longitudinally extending pillow comprises a wedge-shaped pillow.

3. The lateral slumber support member as in claim 2 wherein said wedge shaped pillow has a triangular cross section, said wedge shaped pillow having oblique side members extending up from a bottom base thereof, which said oblique side members are joined at a top edge thereof.

4. The lateral slumber support member as in claim 3, wherein respective front and rear ends of said wedge shaped pillow are generally flat.

5. The lateral slumber support member as in claim 2 wherein said wedge shaped pillow includes a pillow interior body insertable within said wedge-shaped pillow, said wedge shape pillow being sewn permanently to said support sheet, which said wedge-shaped pillow opens by a linearly extending opener means extending along a top edge thereof.

6. The lateral slumber support member as in claim 5, wherein said linearly extending opener means is a zipper.

7. The lateral slumber support member as in claim 8, wherein said wedge shaped interior pillow body comprises a firm compressible elastic material.

8. The lateral slumber support member as in claim 7, wherein said firm compressible elastic material is foam.

9. The lateral slumber support member as in claim 1 wherein said longitudinally extending pillow extends along an imaginary line substantially dividing said support sheet in half.

* * * * *